US005176459A

United States Patent [19]

Bessho et al.

[11] Patent Number: 5,176,459

[45] Date of Patent: Jan. 5, 1993

[54] APPARATUS FOR PRESSING A PRINT HEAD IN A PRINTER

[75] Inventors: Kazuya Bessho, Amagasaki; Hisashi Uemura, Nishinomiya; Takayasu Hongo, Kobe, all of Japan

[73] Assignee: Kanzaki Seishi Co., Ltd., Tokyo, Japan

[21] Appl. No.: 716,781

[22] Filed: Jun. 18, 1991

[30] Foreign Application Priority Data

Jun. 25, 1990 [JP] Japan ..... 2-67340

[51] Int. Cl.[5] ..... B41J 23/02; B41J 23/12

[52] U.S. Cl. ..... 400/160; 400/120

[58] Field of Search ..... 400/432, 120, 160

[56] References Cited

U.S. PATENT DOCUMENTS 4,775,869 10/1988 Minowa ..... 400/185
4,911,566 3/1990 Imaseki et al. ..... 400/120
5,036,338 7/1991 Imai ..... 400/120

FOREIGN PATENT DOCUMENTS 0205784 11/1983 Japan ..... 400/120
0082757 4/1988 Japan ..... 400/120

*Primary Examiner*—Edgar S. Burr
*Assistant Examiner*—Lynn D. Hendrickson
*Attorney, Agent, or Firm*—Schweitzer Cornman & Gross

[57] ABSTRACT

An apparatus for pressing a print head against a platen roll in a printer, which comprises a rotating profiled cam supporting the print head for moving the print head toward and away from the platen roll, a shaft in the center of and integral with the cam for rotating the cam, the profile of the claim having an arcuate cam edged section points of which along the arcuate edge section are at a gradually and smoothly continuously increasing distance from the shaft, and a circular cam edge section seamlessly continuously adjoining the arcuate edge section, points of the circular cam edge section along the circular edge being equidistant from the shaft, whereby the print head supported from the edge section of the cam is pressed against the platen roll at a constant pressure when the print head is supported from the circular edge section of the cam.

5 Claims, 2 Drawing Sheets

APPARATUS FOR PRESSING A PRINT HEAD IN A PRINTER

FIELD OF THE INVENTION

The present invention relates generally to the improvement in a thermal or thermal transfer line printer for producing characters and the like from computer data upon paper.

BACKGROUND OF THE INVENTION

In a thermal type line printer generally an elongated print head is arranged transversely in relation to a sheet of printing paper for exerting heat on paper to produce characters of dots. The print head is constructed to move toward and away from a platen roll so that the beginning of the sheet of printing paper can easily pass through between the print head and the platen roll, prior to the printing step. The movement of the print head in relation to the platen roll is ordinarily performed by a cam mechanism. First the print head is set in a position further from the platen roll, and the end of the printing paper sheet is caused to pass through a space between the platen roll and the print head. Next, the print head is moved toward the platen roll until the print head presses the sheet against the platen roll with a preselected pressure. Printing is performed while the sheet is moved by rotating the roller. In addition, the exterior surface of the platen roll is covered with a rubber or the like layer to provide elasticity and to ensure forward movement of the printing sheet and the printing quality of characters on the sheet. Printing with the thermal printer is achieved by bringing a thermal head provided with numerous heating elements into contact with a thermally sensitive paper, and by using the heat from any of the heating elements on the sensitive paper to a color change and appearance of characters due to the heat.

Printing by thermal transfer printer is achieved by bringing a thermal head provided with heating elements into contact with a film having thermoplastic ink applied to its reverse side, and melting the ink with the heat from any of heating elements and then transferring the molten ink to normal paper.

In the prior art, as shown in the cam mechanism of FIG. 4, comprises a rotating cam 13 having a curved cam edge 13*a*. The radius (i.e. the distance from a rotating shaft 14) or the cam edge continuously increases away from the rotating shaft 14, and terminates in a straight line-like edge. The print head is supported on and guided along the curved edge 13*a* of the cam plate 13 so that with the rotation of the cam plate 13 the print head moves toward and away from the platen roll, depending upon the profile of the curved edge part 13*a* presenting points of different distances from the rotating shaft 14. Accordingly, when it is desired that the print head move away from the platen roll to set the end of the printing sheet along the platen roll, the cam plate 13 is rotated so that the print head is supported on a relatively small radius section on the side of the curved edge 13*a* of the cam. On the other hand, when it is desired that the print head is moved toward the platen roll and then press the sheet against the platen roll at a predetermined pressure for the printing step, the cam plate 13 is rotated at a predetermined angle of rotation by a limit switch or the like in such a direction that a section of relatively large radius side of the cam curved edge 13 approaches the print head, and then the cam 13 is stopped so that the print head becomes supported at a fixed position on the curved edge 13*a* which is mediately distant from the rotating shaft 14.

In operation of the above-described cam mechanism, however, it is very difficult to stop the rotating cam plate 13 accurately at a predetermined angle of rotation. Thus, with variation of rotational angle or the location at which the rotating cam 13 is stopped, the pushing force of the print head against the platen roll undergoes a change, so that a disadvantageous disturbance of printing characters is likely to occur on the paper.

SUMMARY OF THE INVENTION

It is accordingly a primary object of the present invention to provide an apparatus which can keep a print head against a platen roll at a constant pressure during printing.

With the above object in view, the apparatus for pressing a print head against a platen roll according to the present invention utilizes a rotating cam capable of moving the print head supported thereon toward and away from the platen roll, wherien the cam has an integral rotating cam shaft and the profile of the cam surface comprises an arcuate edge shaped so that a radius taken from the rotating cam shaft continuously increases in a rotational direction and a circular cam surface section of a fixed radius which is smoothly continuous with an increasing radius section of said cam surface, whereby the print head is pressed against the platen roll at a constant pressure when the cam is rotated at a rotational angle at which the circular cam edge section will support the print head. In other words, movement of the print head toward and away from the platen roll is brought about by the rotating cam on which the print head is supported, and the location of the print head in relation to the platen roll depends on the instantaneous radius of the cam. This means that the distance from the central location of the cam shaft to the periphery of the cam at the position in contact with the thermal head, and the pushing force of the print head against the platen roll depends on the location of the print head within the range of contact with the platen roll. Accordingly, to keep the pushing force of the print head against the platen roll at a constant value, it is essential to maintain the print head at a fixed position during the printing step, i.e., when the print head presses against the platen roll. However, with the conventional rotating cam the pushing force of the print head varies with the rotational angle of the cam because the cam has a continuously varying radius, since there is only one given angle of rotation that corresponds to a specified pushing force. Therefore, a slight deviation in the stopping location of the cam makes it difficult to provide the required specific pushing force to the platen roll.

In contrast to the conventional cams a rotating cam plate in accordance with the present invention has a profile comprising an arcuate cam edge section shaped so that a a radius from the rotating shaft at a central point of the cam continuously increases in a rotational direction and a circular cam edge surface section of a fixed radius, that is smoothly continuous with an increasing radius of said cam arcuate edge surface section, enables continuous exertion of a specific pushing force upon the platen roll when the cam plate is rotated and stopped within a range of rotational angles at which the circular cam edge section of fixed radius supports the print heat. Accordingly, even when the circular cam edge section in a printing step slightly deviates from a predetermined stop location within the aforementioned range of rotational angels, the print head presses against the platen roll at a constant pressure without any problems so that uniform characters are produced on the paper.

The second object of the present invention is to provide a means within the above-described apparatus for pressing a print head against a platen roll, which starts a print head printing on paper when the print head is subjected to a suitable pressure.

For the achievement of such an object, the present invention provides a detector to detect and then communicate by a detection signal that the circular cam edge section is brought into contact with the print head.

Although it is restricted to a specific form, an example of the detectors most convenient and certain detection is provided by a structure in which light source and a light sensor are combined with a light shielding plate rotatable integrally with the rotating cam. The light source and the light sensor are arranged to face one another with the cam between them. The light shielding plate either permits the light from the light sensor to reach the light sensor, or prevents the light from reaching the light sensor when the cam is rotated within a limited range of rotational angels at which the circular cam edge section supports the print head, so that the light sensor can automatically detect when the print head is in contact with the circular cam edge section. In addition, the light sensor sends a detection signal after detecting the aforesaid contact so that an operating control unit of the printer can switch the printing mechanism on in response to the detection signal. Incidentally, the operating control unit can be optionally so designed that it can connect with an indicator such as a pilot lamp or a display for indicating a printing or printable state to an operator.

DESCRIPTION OF THE DRAWING

The present invention is described by reference to the accompanying drawing in which.

DETAILED DESCRIPTION OF THE INVENTION

Figure 1:
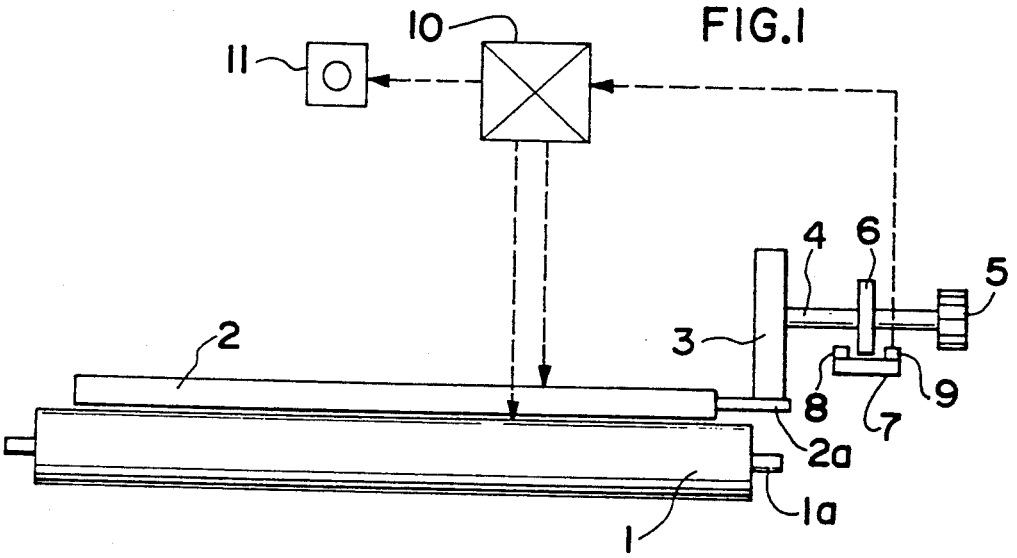
FIG. 1 is a diagrammatic elevational view of an apparatus for pressing a print head, in accordance with the present invention.

Referring to FIG. 1, a platen roller 1 has its surface covered with rubber. The platen roller 1 is rotated by a central shaft 1*a* provided integrally therein, and protrudes from both ends of the roll. A thermal head 2 is located parallel to the platen roll, for exerting heat on paper to produce characters of dots. The thermal head 2 is pivotally connected to a shaft (not shown) to enable its movement toward and away from the platen roll 1. The thermal head 2 is ordinarily biased by a spring toward a direction where to go away from the platen roll.

A rotating cam 3 is provided for supporting the thermal head 2. The cam is secured to one end of a rotating shaft 4, to be rotated by that rotating shaft as a knob 5 which is fixed on the other end of the rotating shaft 4 is turned. The thermal head 2 contacts the peripheral edge surface of the cam. A projecting peg 2*a* is attached to one end of the thermal head 2, for contacting and following the cam surface. The projecting peg 2*a* is forced against the cam edge surface by the bias of the aforementioned spring. Rotation of the cam 3 can be carried out by use of an electric motor or electromagnet (not shown).

Figure 2:
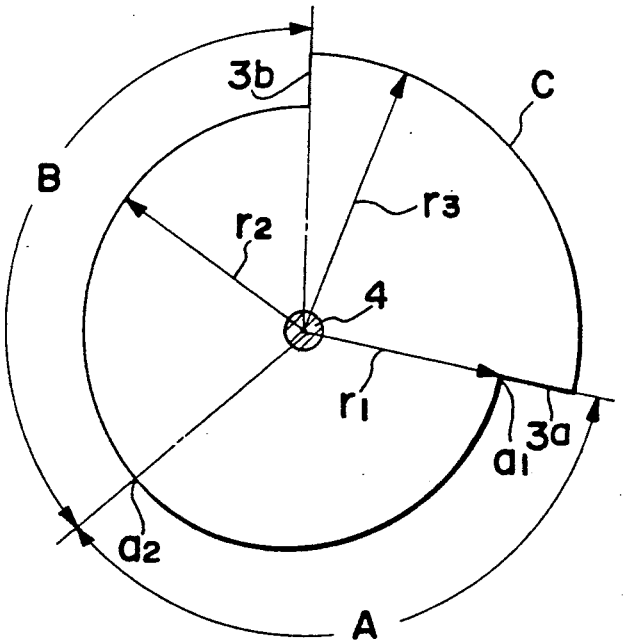
FIG. 2 is a plan view of a rotating cam used in the apparatus of the present invention.

The cam 3, which is secured to the rotating shaft 4, is shown in FIG. 2 as comprised of three peripheral sections, A, B, and C that differ from each other in their shape, i.e., an arcuate cam edge section A is so shaped that a radius from the rotating shaft 4 increases continuously in a clockwise direction form the minimum reference radius $r_1$ at $a_1$ to the maximum radius $r_2$ at $a_2$; a circular cam edge section B of a fixed radius $r_2$ which is smoothly continuous with the arcuate cam edge section A at $a_2$ along an increasing radius; a stepped circular edge protrusion section C of a radius $r_3$ larger than the maximum radius $r_2$ which steeply rises away from the remaining cam sections A and B. The steep steps 3*a*, 3*b* on both sides of the section C serves as a stopping surface.

As shown in FIG. 1, a light shielding plate 6 is fixed halfway on the rotating shaft 4, and a light source 8 and a light sensor 9 oppose each other on a support 7 near the rotating shaft 4, with the light shielding plate 6 located between them upon sensing the light from the source 8, the light sensor 9 sends a light detection signal to an operation control unit 10. The operation control unit 10 switches the printing operation mechanism from an inactive state to a printing state which is indicated to the operator by an indicator light 11 when the control unit 10 receives the light detection signal.

Figure 3:
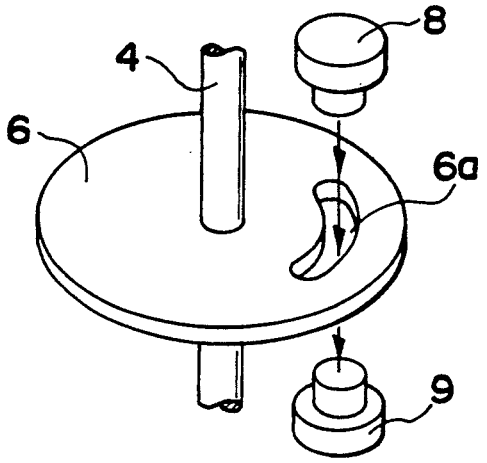
FIG. 3 is a perspective view of a detector incorporated in the apparatus of the present invention.
Figure 4:
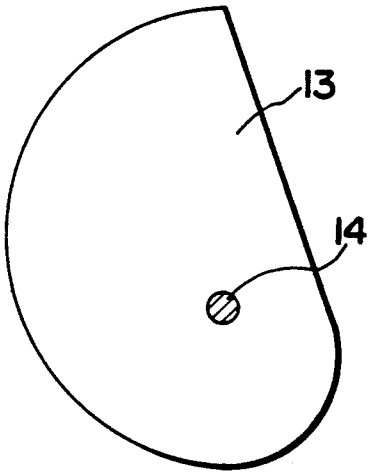
FIG.4 PRIOR ART
FIG. 4 is a plan view of a prior art rotating cam for pressing a print head.

In FIG. 3, the light shielding plate 6, is shown shaped like a circular disk and has the rotating shaft 4 passing through its center. The plate 6 is provided with a light transmitting elongated slit 6*a* that curves along an equal distance from the center. The light source 8 and the light sensor 9 are arranged oppositely along a line parallel to the rotating shaft 4 and perpendicular to the light shielding plate 6. Thus the light from the light source 8 reaches the light sensor 9 when the slit 6*a* crosses the path of the light when the rotation of the light shielding plate 6 brings the slit in alignment with the light. The location and curve length of the light transmitting slit 6*a* in the light shielding plate 6 is determined by the profile of the cam 3 so that the transmission of light from the source 8 to sensor 9 can be achieved in that range of rotational angles of the cam 3 at which the circular edge section B of the cam 3 receives the peg 2*b* of the thermal head 2.

Prior printing on paper with the thermal head 2, the rotating cam 3 is normally set at an angle of rotation at which the arcuate cam edge section A supports the peg 2*a* of the thermal head 2, while the steep 3*a* of the edge protrusion section C contacts the peg 2*a*. This is at an angle of rotation at which the close vicinity of the point $a_1$ of the minimum radius $r_1$ on the arcuate cam edge section A comes to support the peg 2*a* of the thermal head 2. At that point of the cam 3, the thermal head 2 is in its farthest position from the platen roll 1, so that it can easily pass the top edge of a thermally sensitive paper through an opening between the thermal head 2 and the platen roll 1 and then feeds the thermal sensitive paper onwards by a paper feed mechanism (not shown). After the thermally sensitive paper is draped over the platen roll 1 in preparation for printing, the cam 3 is rotated by turning the knob 5 until the steep step 3*b* of the edge protrusion section C contacts the peg 2*a* of the thermal head 2. At this point the thermal head 2 presses against the platen roll 1 at a constant pressure, the light sensor 9 senses the light of the course 8 transmitted through the slit 6*a* of the light shielding plate 6, and sends alight detection signal to the preparation control unit 10. The operation control unit 10 thereupon sets the printing operation mechanism in a printing state and switches on a pilot lamp of the indication device 11 to inform the operator of that state. Upon the operator initiating the starting of printing, such as by actuating a switch, the platen roll 1 will begin to rotate and feed the thermally sensitive paper onward and the thermal head issues heat and produces a row of characters of dots upon the thermally sensitive paper in successive lines.

While one embodiment of the invention is described and illustrated herein, it is intended to be representative only, as changes can be made without departing from the present invention as defined by the claims.

We claim:

1. An apparatus for pressing a print head against a platen roll in a printer, which comprises a rotating profiled cam having a peripheral surface supporting the print head for moving the print head toward and away from the platen roll, means for pressing the print head against the peripheral surface of the cam, a shaft in the center of and integral with said cam for rotating the cam, said peripheral surface having three peripheral sections, an arcuate first peripheral surface section for gradually and smoothly changing the distance between the print head and the platen roll, points along said arcuate first peripheral surface section being at a gradually increasing distance from the shaft until a smooth, gradual transition into a circular second peripheral surface section for maintaining the print head against the platen roll, points along said circular second surface section being equidistant from said shaft, and a third peripheral surface section disposed between those ends of said arcuate first and circular second peripheral surface sections that are opposed to their ends at said smooth, gradual transition, each of the respective ends of said third peripheral surface section defining abrupt peripheral stopping surfaces for preventing the rotation of the cam past each of said abrupt stopping surfaces.

2. The apparatus of claim 1, wherein the cam profile of said third peripheral surface section comprises a stopping edge protrusion section points along which are on an abruptly steeply increasing rise away from the shaft and from the other said peripheral surface sections.

3. The apparatus of claim 1, further comprising a detector for detecting when the circular second peripheral surface section of the cam supports the print head, and for generating a signal upon said detecting.

4. The apparatus of claim 3, wherein said detector comprises a light shielding plate attached from the shaft of the cam to rotate together with the cam, a light source and a light sensor facing one another with the light shielding plate located between them, the light shielding plate being adapted to transmit light from the light source to the light sensor in that position of the cam when its circular second peripheral surface section supports the print head, and to block the light of the light source from reaching the light sensor in that position of the cam when the print head is not supported from the circular second peripheral surface section.

5. The apparatus of claim 3, wherein said detector comprises a light shielding plate attached from the shaft of the cam to rotate together with the cam, a light source and a light sensor facing one another with the light shielding plate being located between them, the light shielding plate being adapted to block the light of the light source from the light sensor in that position of the cam when its circular second peripheral surface section supports the print head, and to pass the light from the light source to the light sensor in that position of the cam when the print head is not supported from the circular second peripheral surface section.

* * * * *